US007928998B2

(12) United States Patent
Jang

(10) Patent No.: US 7,928,998 B2
(45) Date of Patent: Apr. 19, 2011

(54) METHOD AND APPARATUS FOR DRIVING LIQUID CRYSTAL DISPLAY TO ADJUST IMAGE QUALITY

(75) Inventor: Chul Sang Jang, Sungham-shi (KR)

(73) Assignee: LG Display Co., Ltd., Seoul (KR)

( * ) Notice: Subject to any disclaimer, the term of this patent is extended or adjusted under 35 U.S.C. 154(b) by 832 days.

(21) Appl. No.: 10/876,626

(22) Filed: Jun. 28, 2004

(65) Prior Publication Data

US 2005/0140615 A1 Jun. 30, 2005

(30) Foreign Application Priority Data

Dec. 29, 2003 (KR) ..... 10-2003-0099236

(51) Int. Cl.
*G09G 5/10* (2006.01)

(52) U.S. Cl. ..... 345/690; 345/98

(58) Field of Classification Search ..... 345/86–88, 345/98, 690; 348/708
See application file for complete search history.

(56) References Cited

U.S. PATENT DOCUMENTS

| | | | | |
|---|---|---|---|---|
| 4,825,201 | A * | 4/1989 | Watanabe et al. | 345/2.1 |
| 5,162,785 | A * | 11/1992 | Fagard | 345/87 |
| 6,297,791 | B1 * | 10/2001 | Naito et al. | 345/89 |
| 6,480,241 | B1 * | 11/2002 | Boccaccio | 348/708 |
| 6,816,191 | B1 * | 11/2004 | Shyu | 348/231.6 |
| 7,013,025 | B2 * | 3/2006 | Hiramatsu | 382/103 |
| 2003/0122845 | A1 * | 7/2003 | Lee et al. | 345/589 |
| 2004/0036704 | A1 * | 2/2004 | Han et al. | 345/690 |

FOREIGN PATENT DOCUMENTS

| | | |
|---|---|---|
| KR | 1995-0008788 | 8/1995 |
| KR | 10-1996-0006551 | 2/1996 |
| KR | 10-0252618 B1 | 1/2000 |
| KR | 10-2001-0049019 A | 6/2001 |

* cited by examiner

*Primary Examiner* — Quan-Zhen Wang
*Assistant Examiner* — Calvin C Ma
(74) *Attorney, Agent, or Firm* — McKenna Long & Aldridge LLP

(57) ABSTRACT

A method and apparatus for driving a liquid crystal display improves a picture quality displayed by a liquid crystal display. A brightness adjuster adjusts a brightness component of input video data and a brightness controller returns the adjusted brightness component to the brightness adjuster when the a value of the adjusted brightness component is outside a predetermined brightness reference range until the brightness adjuster produces a brightness component that is within the predetermined brightness reference range.

18 Claims, 5 Drawing Sheets

METHOD AND APPARATUS FOR DRIVING LIQUID CRYSTAL DISPLAY TO ADJUST IMAGE QUALITY

This application claims the benefit of Korean Patent Application No. P2003-99236, filed on Dec. 29, 2003, which is hereby incorporated by reference for all purposes as if fully set forth herein.

BACKGROUND OF THE INVENTION

1. Field of the Invention

The present invention relates to a liquid crystal display. More particularly, the present invention relates to a method and apparatus for driving a liquid crystal display that facilitates the setting and maintenance of display parameters and improves a picture quality of a liquid crystal display panel.

2. Discussion of the Related Art

Generally, a liquid crystal display (LCD) controls light transmittance characteristics of liquid crystal cells in accordance with externally applied video signals to thereby display a picture. Active matrix type LCDs include switching devices (i.e., thin film transistors (TFTs)) formed at each liquid crystal cell and are used as monitors for computers, office equipment, cellular phones, and the like.

FIG. 1 schematically illustrates a related art LCD driving apparatus.

Referring to FIG. 1, the related art LCD driving apparatus generally includes a liquid crystal display panel 2 having m×n number of liquid crystal cells (Clc) arranged in a matrix pattern, m number of data lines D1 to Dm, n number of gate lines G0 to Gn crossing the m number of data lines D1 to Dm, TFTs provided at the crossings of the gate and data lines, a data driver 4 for applying data signals to the data lines D1 to Dm, a gate driver 6 for applying scanning signals to the gate lines G1 to Gn, a gamma voltage supplier 8 for supplying gamma voltages to the data driver 4, a timing controller 10 for controlling the data and gate drivers 4 and 6 using synchronizing signals output from system 20, a direct current to direct current (DC/DC) converter 14 for generating voltages supplied to the liquid crystal display panel 2 using a voltage output from a power supply 12, and an inverter 16 for driving aback light 18.

The system 20 applies vertical/horizontal signals Vsync/Hsync, clock signals DCLK, a data enable signal DE, and red, green, and blue video data R, G and B to the timing controller 10.

Provided at each of the liquid crystal cells, the TFTs apply data signals from the data lines D1 to Dm to the liquid crystal cells in response to scanning signals transmitted by the gate lines G1 to Gn. Further, each liquid crystal cell includes a storage capacitor Cst to maintain a voltage charged to the liquid crystal cell. The storage capacitor Cst is provided either between a pixel electrode of the liquid crystal cell Clc and a pre-stage gate line or between the pixel electrode of the liquid crystal cell Clc and a common electrode line.

As mentioned above, the gamma voltage supplier 8 applies a plurality of gamma voltages to the data driver 4. The data driver 4 converts video data R, G and B into analog data voltages (i.e., data signals) using the applied gamma voltages in response to control signals CS output from the timing controller 10. The data driver 4 further applies the data signals to the data lines D1 to Dm.

The gate driver 6 sequentially applies scanning pulses to the gate lines G1 to Gn in response to control signals CS output from the timing controller 10. Upon application of the scanning pulses, horizontal lines of liquid crystal cells within the liquid crystal display panel 2 are supplied with data signals.

The timing controller 10 generates control signals CS to control the gate and data driver 6 and 4 using vertical/horizontal synchronizing signals Vsync and Hsync and the clock signal DCLK output from the system 20. Control signals CS that control the gate driver 6 include a gate start pulse GSP, a gate shift clock GSC, and a gate output enable signal GOE. Control signals CS that control the data driver 4 include a source start pulse SSP, a source shift clock SSC, a source output enable signal SOE, and a polarity signal POL. Further, the timing controller 10 re-aligns video data R, G and B output from the system 20 and applies the re-aligned data to the data driver 4.

The DC/DC converter 14 raises or lowers a voltage of 3.3V output from the power supply 12 to generate voltages suitable for driving the liquid crystal display panel 2. Accordingly, the DC/DC converter 14 generates a gamma reference voltage, a gate high voltage VGH, a gate low voltage VGL, and a common voltage Vcom.

The inverter 16 applies a driving voltage (or driving current) to drive the back light 18. Upon receiving the driving voltage (or driving current), the back light 18 generates light. The generated light is subsequently emitted to the liquid crystal display panel 2.

Driving the liquid crystal panel 2 as described above is undesirable, however, because defective images are displayed when brightness and chrominance components of input video data R, G and B are above or below reference value ranges.

SUMMARY OF THE INVENTION

Accordingly, the present invention is directed to a method and apparatus for driving a liquid crystal display that substantially obviates one or more of the problems due to limitations and disadvantages of the related art.

An advantage of the present invention provides a method and apparatus for driving a liquid crystal display that ensures data is applied within a predetermined range to improve a picture quality of the liquid crystal display.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a driving apparatus for a liquid crystal display may, for example, include a brightness adjuster for adjusting brightness component of input video data; and a brightness controller that returns the adjusted brightness component to the brightness adjuster when the a value of the adjusted brightness component is outside a predetermined brightness reference range until the brightness adjuster produces a brightness component that is within the predetermined brightness reference range.

In one aspect of the present invention, the driving apparatus may further include a chrominance adjuster for adjusting a chrominance component of the input video data; and a chrominance controller that returns the adjusted chrominance component to the chrominance adjuster when the adjusted chrominance component is outside predetermined chrominance reference range until the adjusted chrominance component is within the predetermined reference chrominance range.

In another aspect of the present invention, the driving apparatus may further include a brightness/chrominance separator for separating the brightness and chrominance components from the input video data; a brightness comparator that compares the adjusted brightness component with the predetermined brightness reference range; a chrominance comparator that compares the adjusted chrominance component with the predetermined chrominance reference range; and a brightness/chrominance mixer that mixes the brightness and chrominance components when the adjusted brightness and chrominance components are within the predetermined brightness and chrominance ranges.

In still another aspect of the present invention, the driving apparatus may further include an external setting means for setting the predetermined brightness and chrominance reference ranges and outputting the predetermined brightness and chrominance reference ranges to respective ones of the brightness and chrominance comparators.

According to principles of the present invention, a method of driving a liquid crystal display may, for example, include adjusting a brightness component of input video data; and further adjusting the adjusted brightness component to within a predetermined brightness reference range if the adjusted brightness component is outside the predetermined brightness reference range.

In one aspect of the present invention, the method may further include adjusting a chrominance component of the input video data; and further adjusting the adjusted chrominance component to within a predetermined chrominance reference range if the adjusted chrominance component is outside the predetermined chrominance reference range.

In another aspect of the present invention, the method may further include separating the brightness and chrominance components from the input video data; comparing the adjusted brightness component with the predetermined brightness reference range; comparing the adjusted chrominance component with the predetermined chrominance reference range; and mixing the brightness and chrominance components when the adjusted brightness and chrominance components are within the predetermined brightness and chrominance reference ranges.

In still another aspect of the present invention, the method may further include setting the predetermined brightness and chrominance reference ranges.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
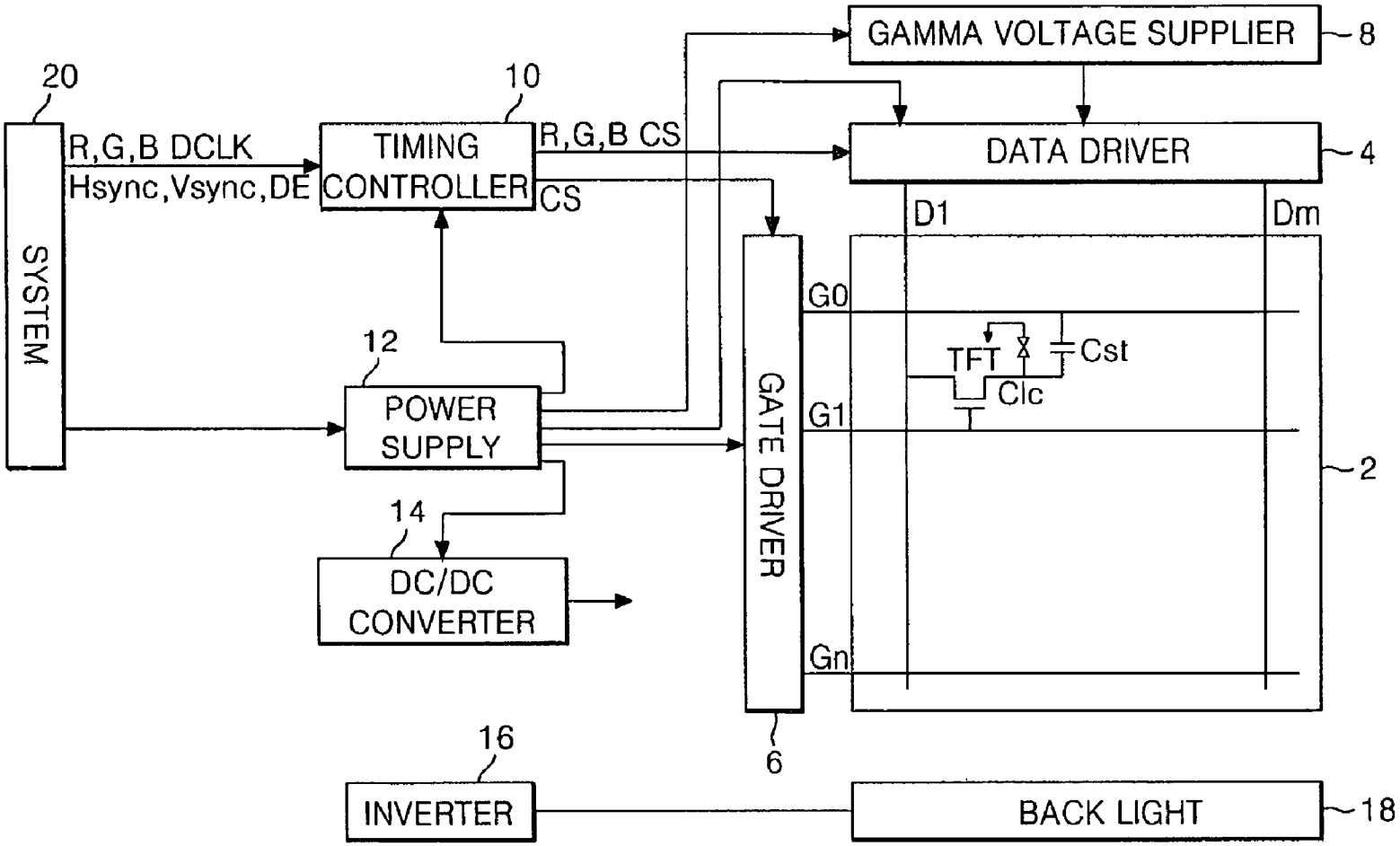
FIG. 1 RELATED ART
FIG. 1 schematically illustrates a related art LCD driving apparatus.
Figure 2:
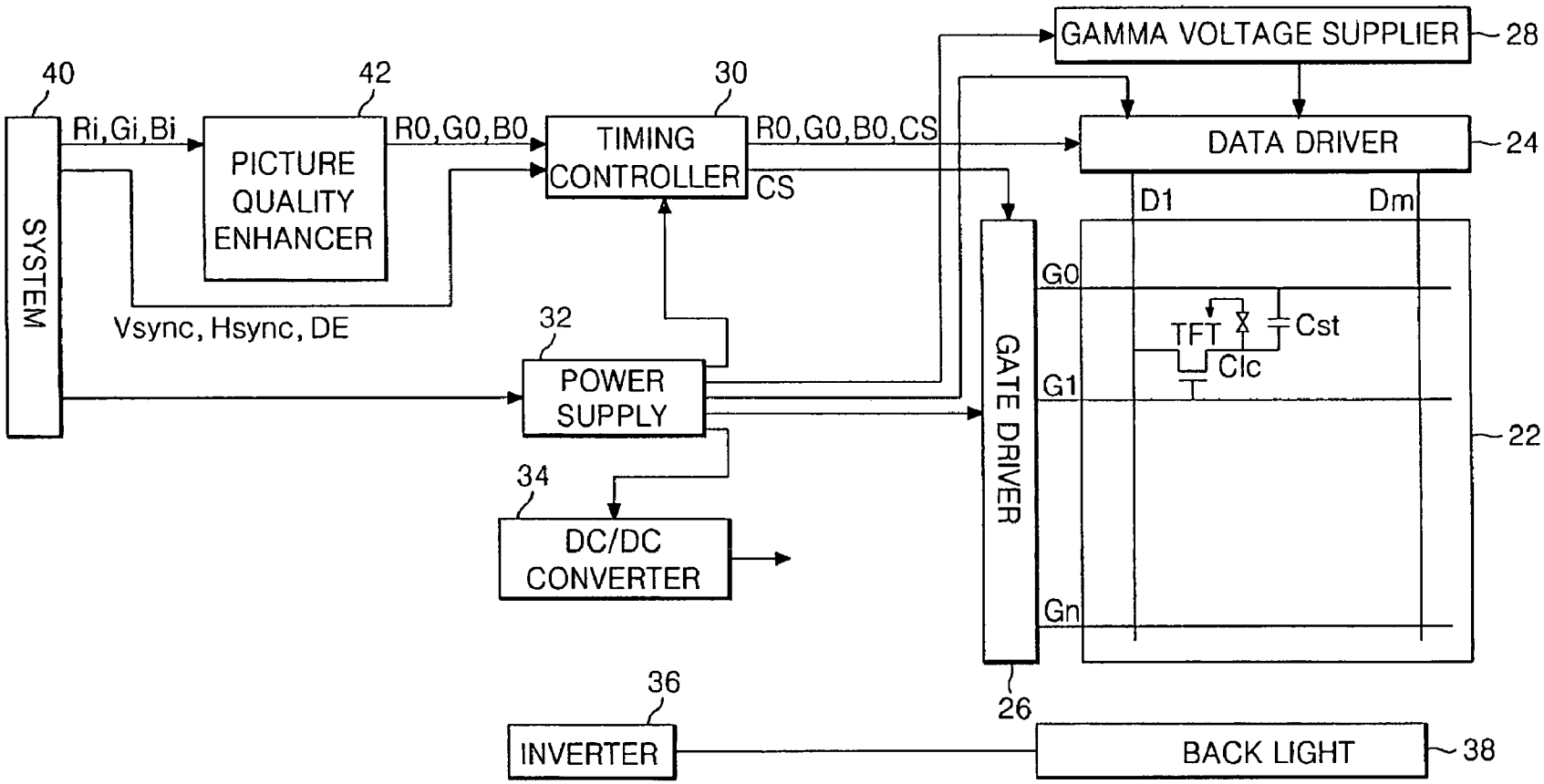
FIG. 2 schematically illustrates a driving apparatus for a liquid crystal display according to principles of the present invention.

FIG. 2 schematically illustrates a driving apparatus for a liquid crystal display according to principles of the present invention.

Referring to FIG. 2, a LCD driving apparatus according to principles of the present invention may, for example, include a liquid crystal display panel 22 having m×n number of liquid crystal cells (Clc) arranged in a matrix pattern, m number of data lines D1 to Dm, n number of gate lines G0 to Gn crossing the m number of data lines D1 to Dm, TFTs provided at the crossings of the gate and data lines, a data driver 24 for applying data signals to the data lines D1 to Dm, a gate driver 26 for applying scanning signals to the gate lines G1 to Gn, a gamma voltage supplier 28 for supplying gamma voltages to the data driver 24, a timing controller 30 for controlling the data and gate drivers 24 and 26 using synchronizing signals Vsync and Hsync output from the system 40, a DC/DC converter 34 for generating voltages supplied to the liquid crystal display panel 22 using a voltage output from a power supply 32, an inverter 36 for driving a back light unit 38, and a picture quality enhancer 42 that compares and analyzing data output from the system 40 and for applying results of the comparing and analyzing to the timing controller 30.

According to principles of the present invention, the system 40 may, for example, supply input video data Ri, Gi and Bi to the picture quality enhancer 42. In one aspect of the present invention, system 40 may also apply vertical/horizontal synchronizing signals Vsync and Hsync, a clock signal DCLK, and a data enable signal DE to the timing controller 30.

As described above, the liquid crystal display panel 22 may, for example, include a plurality of liquid crystal cells Clc arranged in a matrix pattern and defined by crossings of the data lines D1 to Dm and gate lines G1 to Gn. TFTs provided at each liquid crystal cell Clc may apply data signals from each data line D1 to Dm to the liquid crystal cells Clc in response to scanning signals from the gate lines G1 to Gn. Further, each liquid crystal cell Clc may, for example, include a storage capacitor Cst for maintaining voltages charged to the liquid crystal cells Clc. In one aspect of the present invention, the storage capacitor Cst may be provided between a pixel electrode of the liquid crystal display panel 22 and a pre-stage gate line. In another aspect of the present invention, the storage capacitor Cst may be provided between the pixel electrode of the liquid crystal cell Clc and a common electrode line.

Also as described above, the gamma voltage supplier 28 may apply a plurality of gamma voltages to the data driver 24. The data driver 24 may, for example, convert output video data Ro, Go and Bo, applied from the picture quality enhancer 42, into analog data voltages (i.e., data signals) using the applied gamma voltages in response to control signals CS output from the timing controller 30. In one aspect of the present invention, the data driver 24 may apply the data signals to the data lines D1 to Dm.

The gate driver 26 may, for example, sequentially apply scanning pulses to the gate lines G1 to Gn in response to a control signal CS output from the timing controller 30. Upon application of the scanning pulses, horizontal lines of liquid crystal cells within the liquid crystal display panel 22 may be supplied with data signals.

According to principles of the present invention, the timing controller 30 may, for example, generate control signals CS to control the gate and data drivers 26 and 24 using second vertical/horizontal synchronizing signals Vsync2 and Hsync2 and a second clock signal DCLK2 output from the picture quality enhancer 42. In one aspect of the present invention, control signals CS that control the gate driver 26 may, for example, include a gate start pulse GSP, a gate shift clock GSC, a gate output enable signal GOE, and the like. In another aspect of the present invention, control signals CS that control the data driver 24 may, for example, include a source start pulse SSP, a source shift clock SSC, a source output enable signal SOE, a polarity signal POL, and the like. In still another aspect of the present invention, the timing controller 30 may re-align the output video data Ro, Go and Bo, applied from the picture quality enhancer 42 and apply the re-aligned video data to the data driver 24.

The DC/DC converter 34 may, for example, raise or lower a voltage of about 3.3V output from the power supply 32 to generate voltages suitable for driving the liquid crystal display panel 22. For example, the DC/DC converter 14 may generate a gamma reference voltage, a gate high voltage VGH, a gate low voltage VGL, a common voltage Vcom, and the like.

The inverter 36 may, for example, apply a driving voltage (or driving current) to drive the back light unit 38. Upon receiving the driving voltage (or driving current), a back light of the back light unit 38 may generate light. The generated light may subsequently be emitted to the liquid crystal display panel 22.

According to principles of the present invention, the picture quality enhancer 42 may independently adjust values of a brightness component Yi and chrominance components Cri and Cbi using input video data Ri, Gi, and Bi output from the system 40. In one aspect of the present invention, the picture quality enhancer may control the adjusted brightness component Y and the adjusted chrominance components Cr and Cb such that output video data Ro, Go, and Bo have brightness components Yo and chrominance components Cro and Cbo with values that are within predetermined brightness component values and chrominance component values. The output video data Ro, Go, and Bo may be output from the picture quality enhancer 42 to the timing controller 30.

Figure 3:
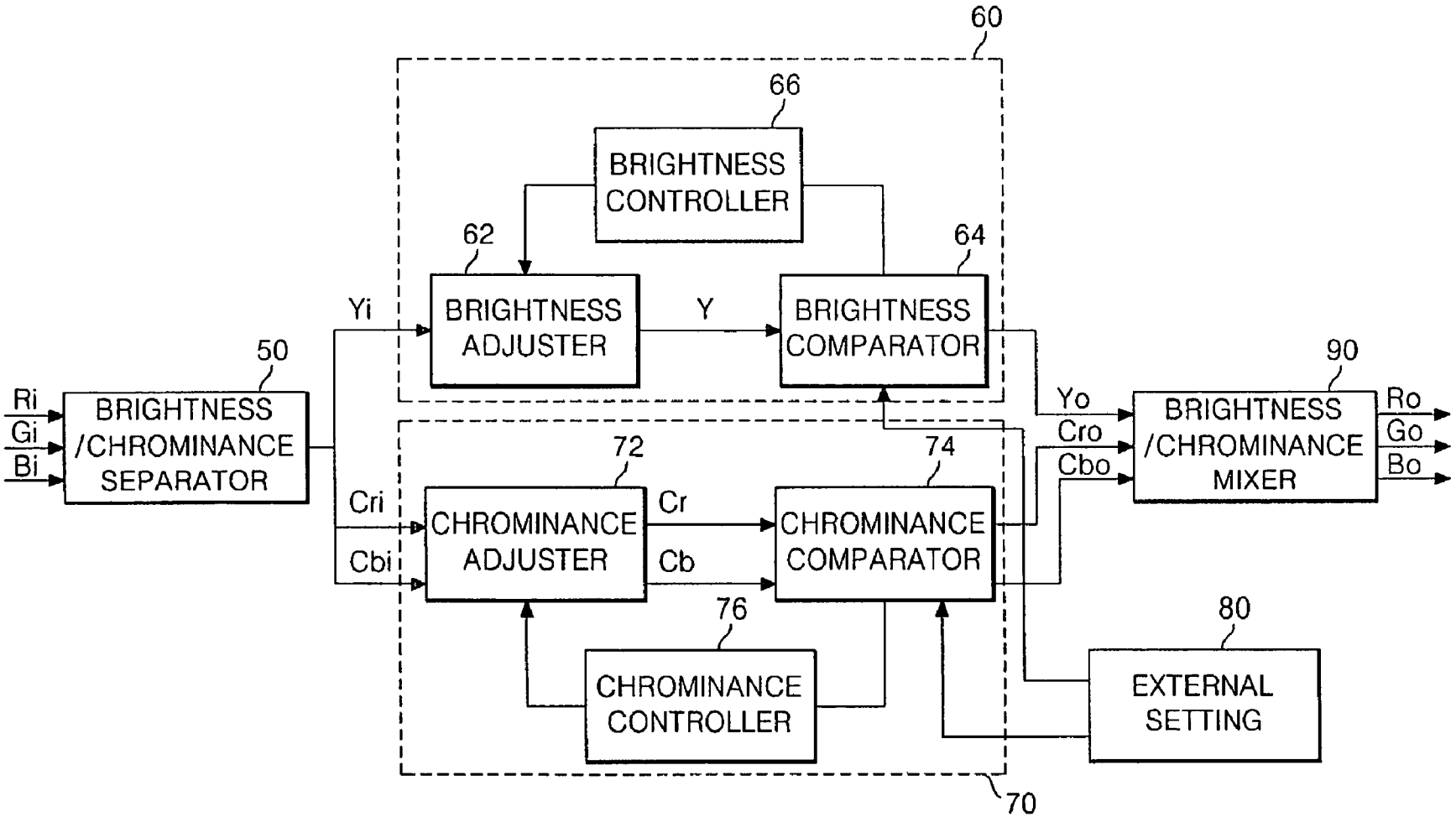
FIG. 3 illustrates a detailed block diagram of the picture quality enhancer shown in FIG. 2.

Therefore, and as shown in FIG. 3, the picture quality enhancer 42 may, for example, include a brightness/chrominance separator 50 for separating a brightness component Yi and chrominance components Cri and Cbi from the input video data Ri, Gi and Bi; a brightness setting unit 60 for receiving the separated brightness components Yi from the brightness/chrominance separator 50 and for setting the separated brightness component Yi to within a predetermined reference value range; a chrominance setting unit 70 for receiving the separated chrominance components Cri and Cbi from the brightness/chrominance separator 50 and for setting the separated chrominance components Cri and Cbi to within a reference value range; an external setting unit for setting reference value ranges of the brightness component Y and chrominance components Cr and Cb output from the brightness setting unit 60 and the chrominance setting unit 70; and a brightness/chrominance mixer 90 for receiving and mixing brightness component Yo and chrominance components Cro and Cbo set by the brightness setting unit 60 and the chrominance setting unit 70 to generate output data Ro, Go and Bo.

In one aspect of the present invention, the brightness/color separator 50 may separate the input video data Ri, Gi and Bi into a brightness component Yi and chrominance components Cri and Cbi.

According to principles of the present invention, the brightness setting unit 60 may receive the separated brightness component Yi output from the brightness/chrominance separator 50 and determine whether or not a value of the separated the brightness component Yi is within a predetermined reference value range. If it is determined that the value of the separated brightness component Yi is within the predetermined reference value range, the brightness setting unit 60 may output the separated brightness component Yi to a brightness/chrominance mixer 90. If, however, it is determined that the value of the separated brightness component Yi is outside the predetermined reference value range, a feed-back loop is created whereby the separated brightness component Yi is processed until the value of the brightness component Yi is within the predetermined reference value range.

Figure 4:
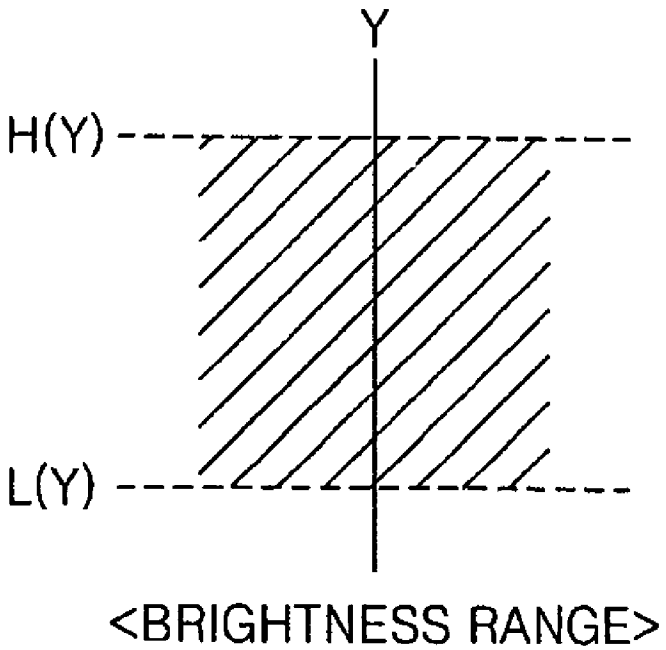
FIG. 4 illustrates a reference value range of a brightness component set at the brightness component comparator shown in FIG. 3.

Accordingly, the brightness setting unit 60 may, for example, include a brightness adjuster 62 for receiving the separated brightness component Yi output from the brightness/chrominance separator 50 and for adjusting a value of the separated brightness component Yi; a brightness comparator 64 that compares a value of the adjusted brightness component Y with brightness components having a value within a predetermined reference value range; and a brightness controller 66 for feeding back (e.g., returning) the adjusted brightness component Y to the brightness adjuster 62 if the brightness comparator 64 determines that the value of the adjusted brightness component Y is outside the predetermined reference value range. In one aspect of the present invention, the brightness controller 64 may, for example, determine whether or not values of the brightness component Y ouput from the brightness adjuster 62 is between high value reference brightness components H(Y) and low value reference brightness components L(Y), wherein the high and low value reference brightness components H(Y) and L(Y) constitute the predetermined reference value range, as shown in FIG. 4.

According to principles of the present invention, the chrominance setting unit 70 may receive the separated chrominance components Cri and Cbi output from the brightness/chrominance separator 50 and determine whether or not the value of the separated chrominance components Cri and Cbi is within a predetermined reference value range. If it is determined that the value of the separated chrominance components Cri and Cbi are within the predetermined reference value range, the chrominance setting unit 70 may output the separated chrominance components Cri and Cbi to a brightness/chrominance mixer 90. If, however, it is determined that the value of the separated chrominance components Cri and Cbi are outside the predetermined reference value range, a feed back look is created whereby the separated chrominance components Cr and Cb are processed until the value of the chrominance components Cri and Cbi are within the predetermined reference value range.

Figure 5:
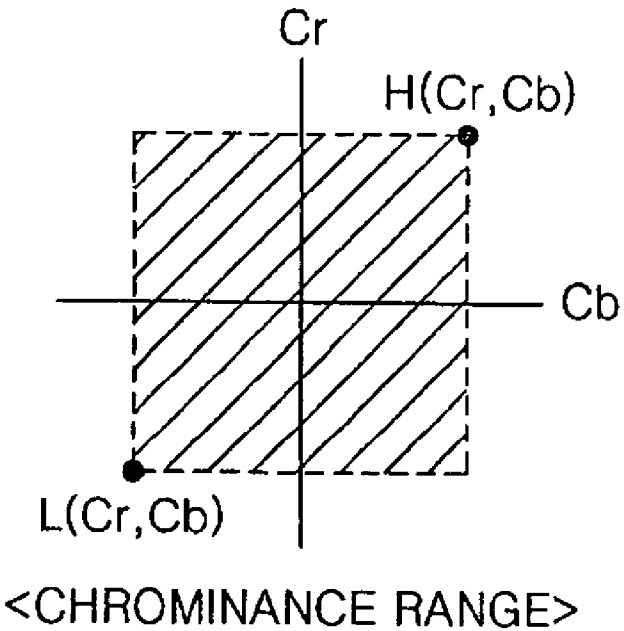
FIG. 5 illustrates a reference value of chrominance components set at the chrominance component comparator shown in FIG. 3.

Accordingly, the chrominance setting unit 70 may, for example, include a chrominance adjuster 72 for receiving the separated chrominance components Cri and Cbi output from the brightness/chrominance separator 50 and for adjusting a value of the chrominance components Cri and Cbi; a chrominance comparator 74 that compares the adjusted chrominance components Cr and Cb with chrominance components having a value within a predetermined reference value range; and a chrominance controller 76 for feeding back (e.g., returning) the adjusted chrominance components Cr and Cb to the chrominance adjuster 72 if chrominance comparator 74 determines that the value of the adjusted chrominance components Cr and Cb are outside the predetermined reference value range. In one aspect of the present invention, the chrominance controller 74 may, for example, determine whether or not values of the chrominance components Cr and Cb output from the chrominance adjuster 72 are between high value reference chrominance component co-ordinates H(Cr, Cb) and low value reference chrominance component co-ordinates L(Cr,Cb), wherein the high and low reference chrominance component co-ordinates H(Cr,Cb) and L(Cr, Cb) constitute the predetermined reference value range, as shown in FIG. 5.

In one aspect of the present invention, the external setting unit 80 may output the individual values of reference brightness components H(Y) and L(Y) to the brightness comparator 64 and may output the individual values of reference chrominance components H(Cr,Cb) and L(Cr,Cb) to the chrominance comparator 74. In another aspect of the present invention, actual values of the reference brightness and chrominance components may be set by the external setting unit 80 and varied as desired or required by a designer, user, manufacturing company, or device. Accordingly, a designer or user may manipulate the external setting unit 80 to define the predetermined reference value range to output values of reference brightness components H(Y) and L(Y) to the brightness comparator 64 and to output values of reference chrominance components H(Cr,Cb) and L(Cr,Cb) to the chrominance comparator 74.

In one aspect of the present invention, the brightness/chrominance mixer 90 may mix the brightness component Yo and the chrominance components Cro and Cbo respectively output from the brightness and chrominance setting units 60 and 70, respectively, to generate output video data Ro, Go and Bo having brightness and chrominance values within the various predetermined reference value ranges. In another aspect of the present invention, the brightness/chrominance mixer 90 may supply the output video data Ro, Go and Bo to the timing controller 30.

Having described the picture quality enhancer 42 in accordance with principles of the present invention, an operation procedure of the picture quality enhancer 42 described above will now be described in greater detail.

Initially, the brightness/chrominance separator 50 may separate input video data Ri, Gi and Bi into brightness component Yi and chrominance components Cri and Cbi. The separated brightness component Yi may be output to the brightness adjuster 62 while the separated chrominance components Cri and Cbi may be output to the chrominance adjuster 72.

The brightness adjuster 62 may then adjust a value of the separated brightness component Yi and ultimately output a brightness component Yo having a value within a predetermined reference value range and capable of providing an image having an optimum brightness.

For example, the brightness adjuster 62 may multiply the separated brightness component Yi by a predetermined signal gain to generate adjusted brightness component Y. The adjusted brightness component Y may then applied to the brightness comparator 64.

The brightness comparator 64 may then determine whether or not a value of the adjusted brightness component Y, output from the brightness adjuster 62, is within a predetermined reference value range of H(Y) to L(Y), as set by the external setting unit 80. If it is determined that the value of the adjusted brightness component Y is outside the predetermined reference value range, then the brightness controller 66 returns the adjusted brightness component Y to the brightness adjuster 62. Upon receipt of the returned adjusted brightness component Y, the brightness adjuster 62 further adjusts the value of the previously adjusted brightness component Y and applies the further adjusted brightness component Y to the brightness comparator 64. Again, the brightness comparator 64 may then determine whether or not the a value of the further adjusted brightness component Y output from the brightness adjuster 62 is within a predetermined reference value range of H(Y) to L(Y), as set by the external setting unit 80. Again, if it is determined that the value of the further adjusted brightness component Y is outside the predetermined reference value range, then the brightness controller 66 returns the further adjusted brightness component Y to the brightness adjuster 62. The procedure described above may be repeated until the value of the adjusted brightness component Y is within a value of the predetermined reference value range of H(Y) to L(Y). Once a value of the adjusted brightness component Y is within the reference value range of H(Y) to L(Y), (e.g., upon repeating the procedure described above), brightness component Yo, with a reference value within the predetermined brightness reference value range of H(Y) to L(Y), may be output to the brightness/chrominance mixer 90.

Similarly, the chrominance adjuster 72 may adjust a value of the separated chrominance components Cri and Cbi and ultimately output chrominance components Cro and Cbo having values within a predetermined reference value range and capable of providing an image having optimum chrominance characteristics.

For example, the chrominance adjuster 72 may multiply the separated chrominance components Cri and Cbi by a predetermined signal gain to generate adjusted chrominance components Cr and Cb. The adjusted chrominance components Cr and Cb may then be applied to the chrominance comparator 74.

The chrominance comparator 74 may then determine whether or not a value of the chrominance components Cr and Cb output from the chrominance adjuster 72 are within a predetermined reference value range of H(Cr,Cb) to L(Cr, Cb), as set by the external setting unit 80. If it is determined that the value of the adjusted chrominance components Cr and Cb are outside the predetermined reference value range, then the chrominance controller 76 returns the adjusted chrominance components Cr and Cb to the chrominance adjuster 72. Upon receipt of the returned adjusted chrominance components Cr and Cb, the chrominance adjuster 72 further adjusts the value of the previously adjusted chrominance components Cr and Cb and applies the further adjusted chrominance components Cr and Cb to the chrominance comparator 74. Again, the chrominance comparator 74 may then determine whether or not the a value of the further adjusted chrominance components Cr and Cb output from the chrominance adjuster 72 are within a predetermined reference value range of H(Cr,Cb) to L(Cr,Cb), as set by the external setting unit 80. Again, if it is determined that the value of the further adjusted chrominance components Cr and Cb are outside the predetermined reference value range, then the chrominance controller 76 returns the further adjusted chrominance components Cr and Cb to the chrominance adjuster 72. The procedure described above may be repeated until the value of the adjusted chrominance components Cr and Cb are within a value of the predetermined reference value range of H(Cr,Cb) to L(Cr,Cb). Once a value of the adjusted chrominance components Cr and Cb are within the reference value range of H(Cr,Cb) to L(Cr,Cb), (e.g., upon repeating the procedure described above), chrominance components Cro and Cbo, with reference values within the predetermined chrominance component values, may be output to the brightness/chrominance mixer 90.

The brightness/color mixer 90 may receive brightness component Yo, having a value within the predetermined reference value range of H(Y) to L(Y), output from the brightness setting unit 60 while receiving chrominance components Cro and Cbo, having values within the predetermined reference value range of H(Cr,Cb) to L(Cr,Cb), output from the chrominance setting unit 70. The brightness/color mixer 90 may then generate output video data Ro, Go and Bo using the various brightness and chrominance components Yo, Cro, and Cbo and applies the output video data Ro, Go, and Bo to the timing controller 30.

Thus, the principles of the present invention enable brightness and chrominance components of input video data Ri, Gi and Bi, output from the system 40, to be analyzed and converted into output video data Ro, Go and Bo having brightness and chrominance components Yo, Cro, and Cbo within predetermined reference value ranges as desired by a designer or user and applied to a liquid crystal display panel 22. Accordingly, optimum conditions desired and set by a designer or user may be constantly maintained to improve a picture quality of the liquid crystal display panel 22.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A apparatus adjusting image quality in a liquid crystal display, comprising:

a brightness adjuster that adjusts a value of a brightness component of input video data from a system and outputs the adjusted brightness component;

a brightness comparator that compares a value of the adjusted brightness component of input video data from the brightness adjuster with a predetermined brightness reference range, between high and low value reference brightness components, determines whether or not a value of the adjusted brightness component from the brightness adjuster is within the predetermined brightness reference range, outputs the adjusted brightness component from the brightness adjuster when the value of the adjusted brightness component from the brightness adjuster is within the predetermined brightness reference range, and outputs the adjusted brightness component within the predetermined brightness reference range when the value of the adjusted brightness component from the brightness adjuster is outside the predetermined brightness reference range; and a brightness controller, connected to the brightness adjuster and to the brightness comparator, that returns the adjusted brightness component to the brightness adjuster when a value of the adjusted brightness component is outside the predetermined brightness reference range based on the comparing result of the brightness comparator, wherein the brightness adjuster further adjusts the adjusted brightness component returned by the brightness controller until the brightness adjuster outputs an adjusted brightness component that is within the predetermined brightness reference range, and wherein the brightness adjuster multiplies the brightness component by a predetermined signal gain to generate the adjusted brightness component and the further adjusted brightness component.

2. The apparatus as claimed in claim 1, further comprising:

a chrominance adjuster that adjusts a value of a chrominance component of the input video data; and a chrominance controller connected to the chrominance adjuster that returns the adjusted chrominance component to the chrominance adjuster when a value of the adjusted chrominance component is outside a predetermined chrominance range, wherein the chrominance adjuster further adjusts the returned chrominance component returned by the chrominance controller until the chrominance adjuster outputs an adjusted chrominance component that is within the predetermined chrominance reference range.

3. The apparatus as claimed in claim 2, further comprising:

a brightness/chrominance separator that separates the brightness and chrominance components from the input video data;

a chrominance comparator that compares a value of the adjusted chrominance component with the predetermined chrominance reference range; and a brightness/chrominance mixer that mixes the adjusted brightness and chrominance components when values of the adjusted brightness and chrominance components are within the predetermined brightness and chrominance reference ranges.

4. The apparatus as claimed in claim 3, further comprising an external setting means that sets the predetermined brightness and chrominance reference ranges and outputs the predetermined brightness and chrominance reference ranges used by brightness and chrominance comparators, respectively.

5. A method adjusting image quality in a liquid crystal display, comprising:

adjusting a brightness component of input video data from a system by a brightness adjuster;

outputting the adjusted brightness component of input video data;

comparing the adjusted brightness component of input video data with a predetermined brightness reference range, between high and low value reference brightness components;

determining whether the value of the adjusted brightness component is within the predetermined brightness reference range based on the comparing;

further adjusting the adjusted brightness component to within the predetermined brightness reference range by a brightness adjuster if the adjusted brightness component is outside the predetermined brightness reference range;

outputting the adjusted brightness component from the brightness adjuster when the value of the adjusted brightness component from the brightness adjuster is within the predetermined brightness reference range; and outputting the adjusted brightness component within the predetermined brightness reference range when the value of the adjusted brightness component from the brightness adjuster is outside the predetermined brightness reference range, wherein the brightness adjuster multiplies the brightness component by a predetermined signal gain to generate the adjusted brightness component and the further adjusted brightness component.

6. The method as claimed in claim 5, further comprising:

adjusting a chrominance component of the input video data;

outputting the adjusted chrominance component; and determining whether the value of the adjusted chrominance component is within a predetermined chrominance reference range; and further adjusting the adjusted chrominance component to within the predetermined chrominance reference range if the adjusted chrominance component is outside a predetermined chrominance range.

7. The method as claimed in claim 6, further comprising:

separating the brightness and chrominance components from the input video data;

comparing the adjusted chrominance component with the predetermined chrominance reference range; and mixing the adjusted brightness and chrominance components when values of the adjusted brightness and chrominance components are within the predetermined brightness and chrominance reference ranges.

8. The method as claimed in claim 7, further comprising setting the predetermined brightness and chrominance reference ranges.

9. A method adjusting image quality in a display, comprising:

receiving input video data from a system;

separating brightness and chrominance components from the received input video data;

adjusting values of the separated brightness and chrominance components of the input video data by a predetermined amount by a brightness adjuster and a chrominance adjuster;

comparing the adjusted brightness component of the input video data with a predetermined brightness reference range, between high and low value reference brightness components;

comparing the adjusted chrominance component of the input video data with a predetermined chrominance reference range, between high and low value reference chrominance components;

determining whether the values of the adjusted brightness and chrominance components are within predetermined brightness and chrominance reference ranges based on the comparing;

further adjusting the adjusted brightness and chrominance components by the brightness adjuster and the chrominance adjuster until values of the further adjusted brightness and chrominance components are within the predetermined brightness reference range and the predetermined brightness reference range;

outputting the adjusted brightness and chrominance components from the brightness adjuster and the chrominance adjuster when the value of the adjusted brightness component from the brightness adjuster is within the predetermined brightness reference range and the value of the adjusted chrominance component from the chrominance adjuster is within the predetermined chrominance reference range;

outputting the adjusted brightness component within the predetermined brightness reference range and chrominance component within the predetermined chrominance reference range when the value of the adjusted brightness component from the brightness adjuster is outside the predetermined brightness reference range and the value of the adjusted chrominance component from the chrominance adjuster is outside the predetermined chrominance reference range;

mixing the adjusted brightness component within the predetermined brightness reference range and chrominance component within the predetermined chrominance reference range; and generating output video data using the mixed brightness and chrominance components, wherein the brightness adjuster multiplies the brightness component by a predetermined signal gain to generate the adjusted brightness component and further adjusted brightness component, and the chrominance adjuster multiplies the chrominance component by a predetermined signal gain to generate the adjusted chrominance component and the further adjusted chrominance.

10. The method of claim 9, wherein the adjusting includes adjusting the separated brightness component independently of the separated chrominance component.

11. The method of claim 9, further comprising externally setting the brightness reference range.

12. The method of claim 9, wherein the adjusting includes adjusting the separated chrominance component independently of the separated brightness component.

13. The method of claim 9, further comprising externally setting the chrominance reference range.

14. A apparatus adjusting image quality in a display, comprising:

a brightness/chrominance separator separating brightness and chrominance components of input video data from a system;

a brightness setting unit connected to the brightness/chrominance separator and adjusting a value of the separated brightness component to within a predetermined brightness reference range, wherein the brightness setting unit adjusts the value of the brightness component of the input video data by a brightness adjuster, compares the adjusted brightness component of the input video data with the predetermined brightness reference range, between high and low value reference brightness components, determines whether the value of the adjusted brightness component is within the predetermined brightness reference range, further adjusts the adjusted brightness component to within the predetermined brightness reference range by the brightness adjuster if the adjusted brightness component is outside the predetermined brightness reference range, outputs the adjusted brightness component from the brightness adjuster when a value of the adjusted brightness component from the brightness adjuster is within the predetermined brightness reference range, and outputs the adjusted brightness component within the predetermined brightness reference range when a value of the adjusted brightness component from the brightness adjuster is outside the predetermined brightness reference range;

a chrominance setting unit connected to the brightness/chrominance separator and adjusting a value of the separated chrominance component to within a predetermined chrominance reference range, wherein the chrominance setting unit adjusts the value of the chrominance component of the input video data by a chrominance adjuster, compares the adjusted chrominance component of the input video data with the predetermined chrominance reference range, between high and low value reference chrominance components, determines whether the value of the adjusted chrominance component is within the predetermined chrominance reference range, further adjusts the adjusted chrominance component to within the predetermined chrominance reference range by the chrominance adjuster if the adjusted chrominance component is outside the predetermined chrominance reference range, outputs the adjusted chrominance component from the chrominance adjuster when a value of the adjusted chrominance component from the chrominance adjuster is within the predetermined chrominance reference range, and outputs the adjusted chrominance component within the predetermined chrominance reference range when a value of the adjusted chrominance component from the chrominance adjuster is outside the predetermined chrominance reference range; and a brightness/chrominance mixer connected to the brightness setting unit and the chrominance setting unit and combining the adjusted brightness component within the predetermined brightness reference range and chrominance components within the predetermined chrominance reference ranges into output video data, wherein the brightness adjuster multiplies the brightness component by a predetermined signal gain to generate the adjusted brightness component and the further adjusted brightness component, and wherein the chrominance adjuster multiplies the chrominance component by a predetermined signal gain to generate the adjusted chrominance component and the further adjusted chrominance component.

15. The apparatus of claim 14, wherein the brightness setting unit includes:

the brightness adjuster connected to the brightness/chrominance separator, the brightness adjuster adjusts the value of the separated brightness component;

a brightness comparator connected to the brightness adjuster and to the brightness/chrominance mixer, the brightness comparator comparing the value of the adjusted brightness component to the values of the brightness reference range; and a brightness controller connected to the brightness comparator and the brightness adjuster, the brightness controller returning the adjusted brightness component to the brightness adjuster based on the comparing.

16. The apparatus of claim 15, further comprising an external setting unit connected to the brightness comparator.

17. The apparatus of claim 14, wherein the chrominance setting unit includes:

the chrominance adjuster connected to the brightness/chrominance separator, the chrominance adjuster adjusts the value of the separated chrominance component;

a chrominance comparator connected to the chrominance adjuster and to the brightness/chrominance mixer, the chrominance comparator comparing the value of the adjusted chrominance component to the values of the chrominance reference range; and a chrominance controller connected to the chrominance comparator and the chrominance adjuster, the chrominance controller returning the adjusted chrominance component to the chrominance adjuster based on the comparing.

18. The apparatus of claim 17, further comprising an external setting unit connected to the chrominance comparator.

* * * * *